US010529521B2

(12) United States Patent
De Palma et al.

(10) Patent No.: US 10,529,521 B2
(45) Date of Patent: Jan. 7, 2020

(54) PROTECTIVE DEVICE FOR AN ELECTRICAL CIRCUIT, ELECTRICAL CIRCUIT PROVIDED WITH SUCH A DEVICE AND METHOD FOR PROTECTING SUCH AN ELECTRICAL CIRCUIT

(71) Applicant: MERSEN France SB SAS, Saint-Bonnet-de-Mure (FR)

(72) Inventors: Gianfranco De Palma, St Barthelemy d'Anjou (FR); Remy Ouaida, Villeurbanne (FR)

(73) Assignee: MERSEN FRANCE SB SAS, Saint-Bonnet-de-Mure (FR)

( * ) Notice: Subject to any disclaimer, the term of this patent is extended or adjusted under 35 U.S.C. 154(b) by 0 days.

(21) Appl. No.: 15/758,494

(22) PCT Filed: Sep. 9, 2016

(86) PCT No.: PCT/EP2016/071280
§ 371 (c)(1),
(2) Date: Mar. 8, 2018

(87) PCT Pub. No.: WO2017/042321
PCT Pub. Date: Mar. 16, 2017

(65) Prior Publication Data

US 2018/0277325 A1 Sep. 27, 2018

(30) Foreign Application Priority Data

Sep. 10, 2015 (FR) ..... 15 58433

(51) Int. Cl.
*H01H 71/12* (2006.01)
*H01H 71/10* (2006.01)
(Continued)

(52) U.S. Cl.
CPC ..... *H01H 71/122* (2013.01); *H01H 71/1045* (2013.01); *H01H 85/0241* (2013.01); *H01H 85/04* (2013.01); *H01H 39/006* (2013.01)

(58) Field of Classification Search
CPC ..... H01H 9/106; H01H 9/54; H01H 39/006; H01H 71/1045; H01H 71/122; H01H 85/0241; H01H 89/00; H01H 85/04
(Continued)

(56) References Cited

U.S. PATENT DOCUMENTS 4,710,847 A 12/1987 Kortschinski et al.
4,920,446 A 4/1990 Pflanz
(Continued)

FOREIGN PATENT DOCUMENTS

CN 101902027 A 12/2010
CN 202363363 8/2012
(Continued)

OTHER PUBLICATIONS

International Search Report for PCT/EP2016/071280, dated Nov. 21, 2016.
(Continued)

*Primary Examiner* — Jacob R Crum
(74) *Attorney, Agent, or Firm* — B. Aaron Schulman, Esq.; Stites & Harbison, PLLC

(57) ABSTRACT

The invention relates to a protective device (2) for an electrical circuit (1), including a first fuse (8), a pyroelectric switch (12) connected in parallel with the first fuse and comprising a control area (16), capable of receiving a trigger signal (S), and a power area (18) for the passage of the electric current. The device also comprises a control circuit configured to produce and transmit the trigger signal to the control area. The device includes a second fuse connected in series between a first input conductor (4) and the first fuse
(Continued)

and capable of supplying a power supply voltage (V) to the control circuit, which is connected between the second fuse and the control area.

10 Claims, 6 Drawing Sheets

(51) Int. Cl.
*H01H 85/02* (2006.01)
*H01H 85/04* (2006.01)
*H01H 39/00* (2006.01)

(58) Field of Classification Search
USPC ..... 337/283
See application file for complete search history.

(56) References Cited

U.S. PATENT DOCUMENTS 6,141,202 A * 10/2000 Maeckel ..... H01H 85/46 337/143
7,075,767 B2 7/2006 Gemme et al.
7,529,072 B2 5/2009 Nishikawa
7,759,825 B2 * 7/2010 Heinrich ..... H01M 2/34 307/139
7,875,997 B2 1/2011 George et al.
2005/0002152 A1 1/2005 Gemme et al.
2007/0025042 A1 2/2007 Nishikawa
2009/0021881 A1 * 1/2009 Crevenat ..... H01T 2/02 361/111
2011/0026183 A1 * 2/2011 Wu ..... H01T 2/02 361/115
2011/0096448 A1 * 4/2011 Wortberg ..... H01H 9/106 361/62

FOREIGN PATENT DOCUMENTS

DE 102010045726 3/2012
WO WO 2012032087 3/2012

OTHER PUBLICATIONS

Written Opinion of the International Searching Authority for PCT/EP2016/071280, dated Nov. 21, 2016.

* cited by examiner

PROTECTIVE DEVICE FOR AN ELECTRICAL CIRCUIT, ELECTRICAL CIRCUIT PROVIDED WITH SUCH A DEVICE AND METHOD FOR PROTECTING SUCH AN ELECTRICAL CIRCUIT

FIELD OF THE INVENTION

The invention relates to a protective device for an electrical circuit, as well as an electrical circuit provided with such a protection device. Lastly, the invention relates to a method for protecting such an electrical circuit.

BACKGROUND OF THE INVENTION

In the field of protecting an electrical circuit, it is known to use a device or a protective electrical component capable of opening the electrical circuit when the latter is traversed by a fault current, such as an overload current or a short circuit current.

In this respect, several protection devices exist, such as fuses. In a known manner, a fuse is a dipole that uses the Joule effect of the electrical current traversing it in order, in case of overload, to cause an electrical conductor to melt that opens the electrical circuit and thus prevents the electrical current from circulating. The fuses are sized as a function of the intensity of the fault current that the system must protect, as well as its opening time. Pyrotechnic circuit breakers are also known, also called "pyroswitches". One limitation of pyrotechnic circuit breakers at this time is their low capacity to cut high voltages, for example greater than 50 V. Indeed, during a cutoff under high-voltage, an electrical arc appears that may cause the device to explode. Furthermore, in order to guarantee the cutoff, the pyrotechnic short-circuits are often bulky.

In this respect, it is also known to use a hybrid protective device characterized by the placement of two protective electrical components in parallel, such as a fuse and a pyroswitch. U.S. Pat. No. 7,875,997-B1 describes one example of such a device. The placement of these two components in parallel provides many advantages. First, the pyroswitch not being as resistive as the fuse, the majority of the electrical current will circulate in the pyroswitch. When the protection is triggered under a fault current, the pyroswitch opens. The fuse still being closed at this stage, it short-circuits the pyroswitch, preventing an electrical arc from appearing within the latter. The current then circulates in the fuse, causing the latter to melt. Such a protective device can be used with high electrical voltages exceeding the limit voltage of the pyroswitch, up to a voltage level equivalent to the caliber of the fuse. Since the fuse experiences only low currents during normal use, it can be small, which reduces its cost and its cutoff time.

However, the pyroswitch must have a command circuit able to supply the cutoff command. Such a command circuit may be complex and for example include a current sensor, a data processing unit and a microcontroller. Thus, the command circuit must be powered by an outside power source. The hybrid protection device, made up of the fuse, the pyroswitch and its command circuit, is not autonomous, and despite lower costs for the fuse, such a device creates a higher cost and bulk, in particular due to the outside supply source.

SUMMARY OF THE INVENTION

The invention more particularly aims to resolve these drawbacks by proposing a new protection device for an electrical circuit that is autonomous, while reducing production costs.

In this spirit, the invention relates to a protective device for an electrical circuit, configured to transmit an electrical current, the protective device comprising:

- a first conductor,
- a second conductor,
- a first fuse connected to the output conductor,
- at least one pyroswitch connected in parallel to the first fuse, the pyroswitch including a command zone, able to receive a triggering signal, and a power zone for the passage of the electrical current, and
- a command circuit configured to develop and transmit the triggering signal to the command zone of the pyroswitch, the device further comprising a second fuse connected in series between the input conductor and the first fuse and able to provide a supply voltage to the command circuit, and in that the command circuit is connected between the second fuse and the command zone of the pyroswitch.

Owing to the invention, the second fuse provides information on the presence of a fault current and the supply voltage necessary for the operation of the command circuit. The command circuit is responsible for generating and transmitting the triggering signal to the pyroswitch. The protective device has a low production cost and bulk, since it does not need an outside power source to trigger the pyroswitch. The protective device thus makes it possible to recover electrical energy generated by the melting of the second fuse. Furthermore, the protective device according to the invention causes very small power losses and improved cut off services.

According to advantageous but optional aspects of the invention, such a protective device may incorporate one or more of the following features, considered in any technically allowable combination:

- the cutoff current of the second fuse is equal to a nominal electrical current value, this nominal current value being defined as the maximum value of the current provided to circulate in the protective device in normal operation, and the cutoff voltage of the first fuse is equal to a nominal electrical voltage value, this nominal voltage value being defined as the maximum value of the voltage provided to be applied across the terminals of the protective device in normal operation.
- the power zone of the pyroswitch has an electrical resistance significantly smaller than that of the first fuse.
- the cutoff current of the first fuse is at least four times less than or equal to the nominal electrical current value, and the cutoff voltage of the second fuse is at least four times less than or equal to the nominal electrical voltage value.
- the device is configured to be successively in a closed configuration where the first and second fuses are not melted, a first intermediate configuration where the second fuse is melted and the supply voltage is provided to the command circuit, and a second intermediate configuration where the pyroswitch is triggered and the first fuse is not melted, and an open configuration where the first and second fuses are melted.
- the device comprises at least two pyroswitches connected in parallel to the first fuse between the first conductor and the second conductor.
- the command circuit includes a potentiometer able to control the triggering signal sent to the command zone of the pyroswitch.

The invention also relates to an electrical circuit configured to be supplied with an electrical current, the electrical circuit being equipped with a protective device according to the invention.

Lastly, the invention relates to a method for protecting an electrical circuit according to the invention, the method including at least the following steps:

a) melting the second fuse caused by a fault current and supplying the command circuit,
b) transmitting, using the command circuit, the triggering signal to the pyroswitch,
c) triggering the pyroswitch and cutting off the power zone of the pyroswitch,
d) melting the first fuse caused by the fault current.

According to one particular embodiment of the invention, during step a), the supply voltage of the command circuit is generated by an electrical arc that is established across the terminals of the second fuse.

BRIEF DESCRIPTION OF THE DRAWING FIGURES

The invention will be better understood and other advantages thereof will appear more clearly in light of the following description of a protective device, an electrical circuit and a method all according to the invention, provided solely as a non-limiting example and done in reference to the appended drawings, in which.

DETAILED DESCRIPTION OF THE INVENTION

Figure 1:
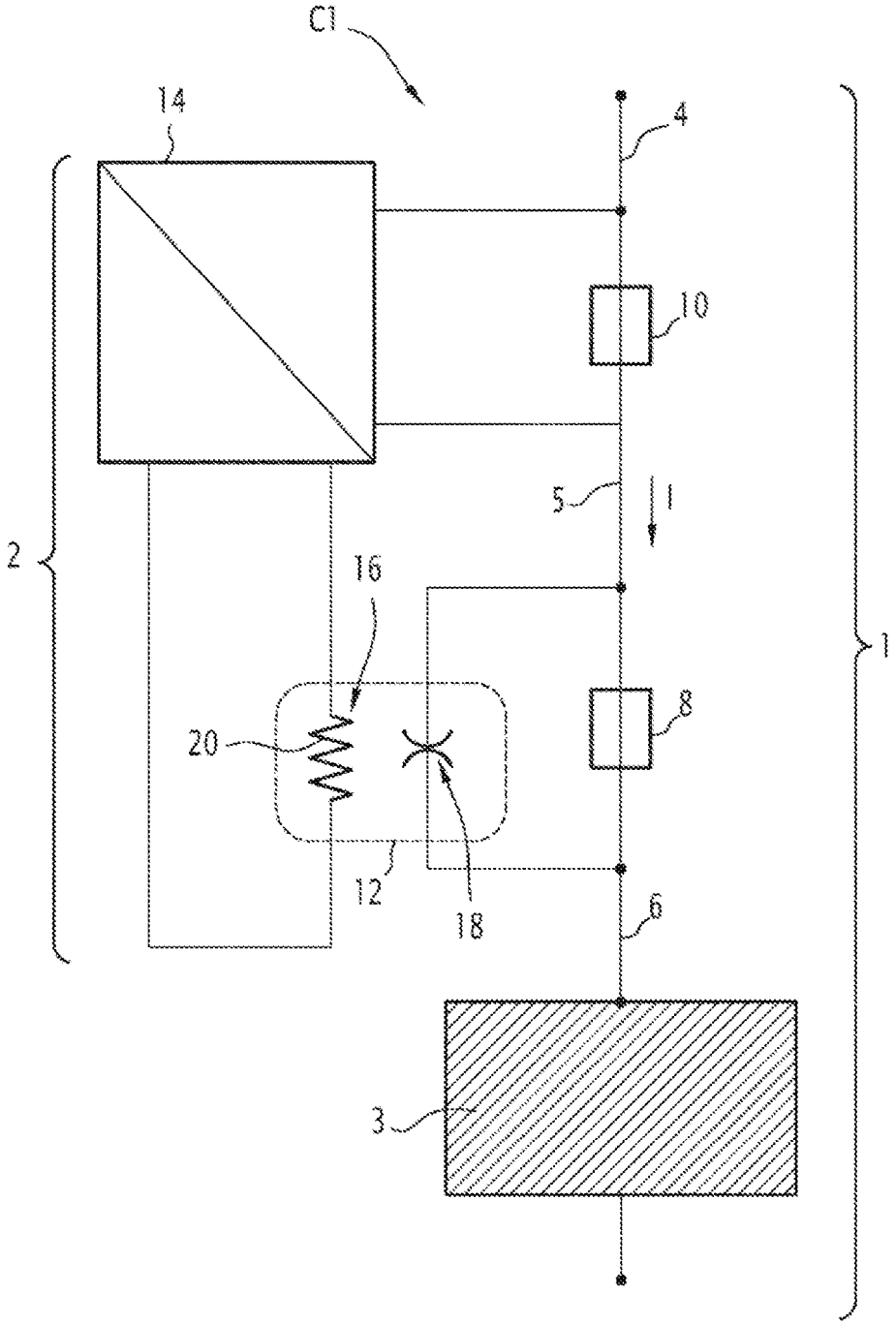
FIG. 1 is a schematic illustration of a protective device according to the invention and an electrical circuit including this protective device.

FIG. 1 shows an electrical circuit 1 configured to be supplied with an electrical current I and equipped with a protective device 2. The electrical circuit 1 comprises a charge 3 and is intended to be connected to a current source (not shown), direct or alternating depending on the charge 3. The protective device 2 is able to open the electrical circuit 1 when the latter is traversed by a fault current. A fault current is considered to be any electrical current I having an intensity greater than or equal to a nominal current value $I_n$, also called nominal current $I_n$. This nominal current value $I_n$ is defined as being the maximum value of the current provided to circulate in the protective device 2 during normal operation. It is predetermined as a function of the nature of the electrical circuit 1. Thus, in the following description, the fault current is defined as the sum of $I_n+I_d$, where $I_d$ designates an overcurrent. The maximum difference in electrical potential that can be applied across the terminals of the protective device 2 while supplying the charge 3, without cutoff by the protective device 2, is called nominal voltage value and denoted $V_n$ hereinafter. This nominal voltage value is also determined as a function of the nature of the electrical circuit. The choice of the nominal current values $I_n$ and the nominal voltage value $V_n$ depends on the nature of the charge 3 to be protected.

The fault current $I_d$ is for example an overload current or a short circuit current and constitutes a risk for the charge 3 of the electrical circuit 1. The protective device 2 comprises a first conductor 4 and a second conductor 6. In this example, the first conductor 4 forms an input conductor for the electrical current, and the second conductor 6 forms an output conductor for the electrical current. The charge 3 is connected to the output conductor. The conductors 4 and 6 are configured to connect the protective device 2 to the rest of the electrical circuit 1, and thus for the passage of any electrical current. In a normal operating state, i.e., without a fault current, the electrical current I that circulates between the conductors 4 and 6 is less than or equal to the nominal current value $I_n$ and the electrical voltage across the terminals of the conductors 4 and 6 is less than or equal to the nominal voltage value $V_n$.

The protective device 2 also comprises a first fuse 8 and a second fuse 10 that are electrically connected in series between the conductors 4 and 6. The first fuse 8 is connected to the output conductor 6, while the second fuse 10 is connected in series between the input conductor 4 and the first fuse 8. Reference 5 denotes an intermediate conductor connecting the fuses 8 and 10 to one another, which is therefore inserted between the conductors 4 and 6.

In a known manner, a fuse is a dipole whose terminals are electrically connected to one another only by a conductor element that is able to be destroyed, generally by melting due to the Joule effect, when it is traversed by an electrical current that exceeds a threshold value. This threshold value here is called "cutoff current". The cutoff voltage of a fuse, called "rated voltage", here is defined as the electrical voltage value across the terminals of the fuse from which the fuse cannot interrupt the passage of the current when the conducting element has been destroyed. When a fuse has begun to melt, if a voltage higher than this rated voltage is applied across its terminals, then an electrical arc forms between these terminals and continues there, allowing the circulation of an electrical current.

Hereinafter, a fuse is said to be "melted" when the conducting element has been destroyed and no electrical arc can form in light of the electrical voltage values present in the electrical circuit 1. An electrically open circuit then forms, through which no electrical current can circulate. A fuse is said to be "in the process of melting" when the electrical current traversing it has exceeded the cutoff current, causing the beginning of melting of the conducting element, but the electrical voltage at its terminals is higher than the rated voltage of this fuse, causing an electrical arc to appear between its terminals. The electrical arc continues as long as the fuse is in the process of melting.

The first and second fuses 8 and 10 have different calibers. In particular, the cutoff current $I_8$ of the first fuse 8 is significantly below the nominal value $I_n$. "Significantly" means that the cutoff current is at least four times, for example ten times or fifty times, lower than the nominal value $I_n$. This dimensioning is made possible by the fact that the first fuse 8 is not normally intended to be traversed by the nominal current $I_n$. The cutoff current $I_{10}$ of the second fuse 10 is equal, in practice to within 1% or 3%, to the nominal value $I_n$. Thus, the cutoff current $I_8$ of the first fuse 8 is significantly lower than the cutoff current $I_{10}$ of the second fuse 10.

The rated voltage $V_8$ of the first fuse 8 is equal, in practice to within 1% or 3%, to the nominal value $V_n$. The rated voltage $V_{10}$ of the second fuse 10 is significantly lower than the nominal value $V_n$. "Significantly" means that the rated voltage is at least four times, for example five times or ten times, lower than the nominal value $V_n$. Thus, the rated voltage $V_{10}$ of the second fuse 10 is significantly lower than the rated voltage $V_8$ of the first fuse 8.

The protective device 2 also comprises a pyroswitch 12 and a command circuit 14.

The pyroswitch 12 is connected in parallel to the first fuse 8 between the intermediate conductor 5 and the output conductor 6. The pyroswitch 12 includes a first zone 16 and a second zone 18.

The first zone 16 is called command zone and is able to receive a triggering signal S. The second zone 18 is called power zone.

The power zone 18 is the part of the pyroswitch 12 that is electrically connected in parallel to the first fuse 8. It is configured for the passage of the electrical current I that supplies the electrical circuit 1. In particular, the power zone 18 has an electrical resistance that is significantly smaller than that of the first fuse 8, for example at least ten times smaller. Thus, when the electrical current I traverses the protective device 2, it is possible to consider that such an electrical current traverses the second fuse 10 and the power zone 18 of the pyroswitch 12, since only a negligible part of the electrical current traverses the first fuse 8.

Figure 2:
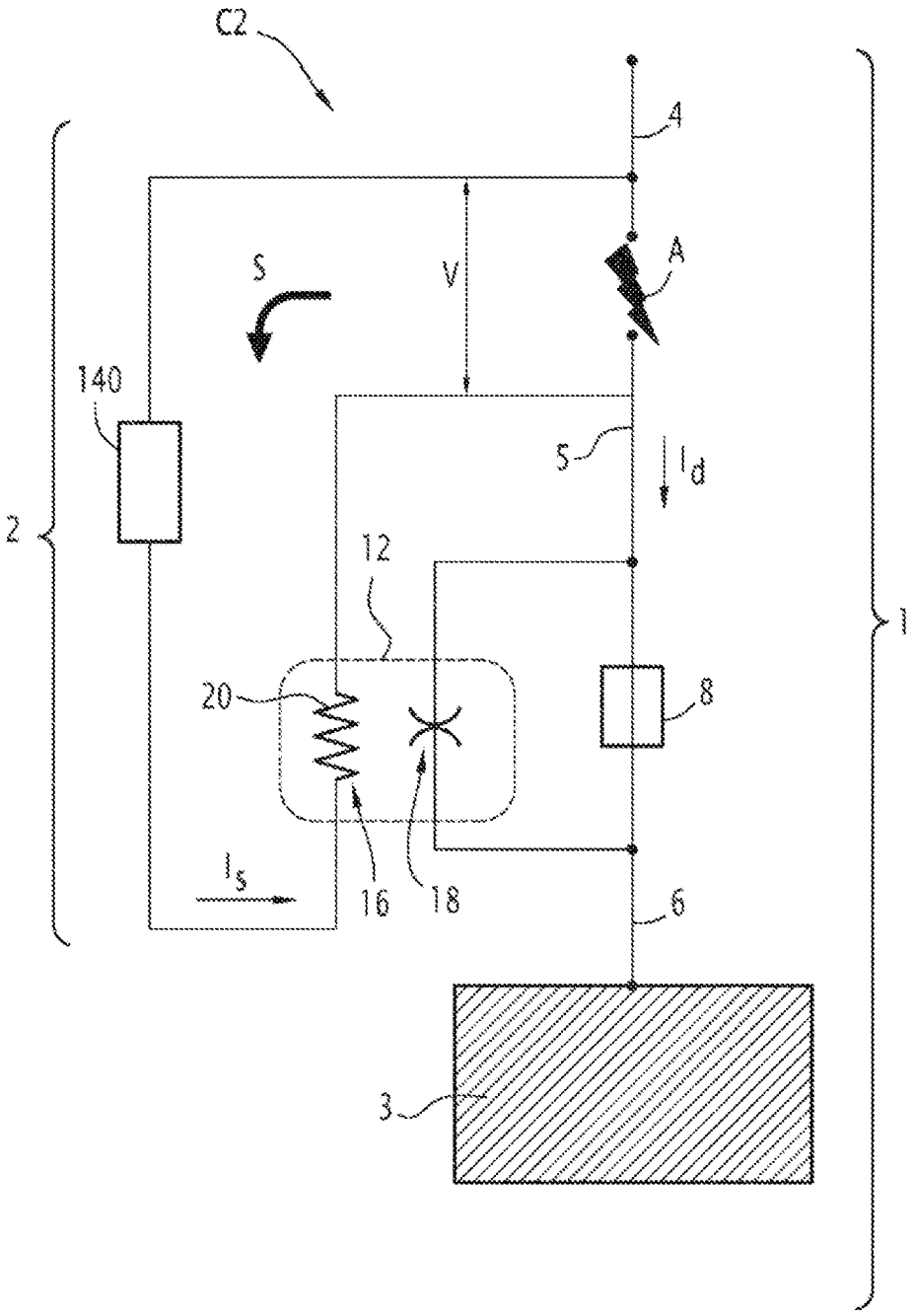
FIG. 2 is a schematic illustration of the protective device in FIG. 1, when a second fuse is melted.

In practice, in the case where an electrical current greater than the nominal current In traverses the protective device 2, the second fuse 10 begins to melt and an electrical arc A, as shown in FIG. 2, begins to appear across its terminals. The electrical current part that traverses the first fuse 8 does not have a sufficient intensity to trigger the melting of the first fuse 8. Thus, the second fuse 10 is dimensioned and positioned to begin to melt before the first fuse 8.

The command zone 16 of the pyroswitch 12 includes a resistance 20 able to heat up when it is traversed by an electrical current. In a known manner, the pyroswitch also includes an explosive agent, not shown, for example an explosive powder, and a cutoff element, such as a piston or a guillotine. The cutoff element, which is not shown, is made from an electrically insulating material, for example plastic. It is able to cut off the power zone 18. In practice, when the resistance 20 of the command zone 16 is traversed by an electrical current, the resistance 20 heats up and triggers the detonation of the explosive agent, which causes the cutoff element to switch from a first position, where it is separated from the power zone 18, to a second position, where it cuts off the power zone 18 so as to interrupt the passage of electrical current in the electrical circuit 1.

The command circuit 14 is configured to develop and transmit the triggering signal S to the command zone 16 of the pyroswitch 12. The command circuit 14 is connected between the second fuse 10 and the command zone 16. In practice, the triggering signal S developed by the command circuit 14 is an electrical triggering current $I_S$ that is transmitted to the command zone 16. Thus, the triggering current $I_S$ traverses the resistance 20 and triggers the pyroswitch 12.

In a known manner, the command circuit 14 can include one or several active and/or passive electrical components for generating and transmitting the triggering signal S. In particular, the command circuit 14 may not include an internal supply source.

According to one alternative that is not shown in the figures, the command circuit 14 includes a potentiometer able to control the triggering current $I_S$ sent to the pyroswitch 12. In practice, the potentiometer is configured to modulate the intensity of the electrical current $I_S$ that is provided to the command zone 16 of the pyroswitch 12. Thus, the tensiometer of the command circuit 14 is configured to control the opening speed of the pyroswitch 12.

Thus, the protective device 2 is configured to be in different configurations C1, C2, C3 and C4, namely a closed configuration C1, a first intermediate configuration C2, a second intermediate configuration C3 and an open configuration C4.

In the closed configuration C1 shown in FIG. 1, the electrical current I that supplies the electrical circuit 1 is below the nominal current $I_n$, and the first and second fuses 8 and 10 are therefore not melted.

In the first intermediate configuration C2 shown in FIG. 2, the electrical current I that supplies the electrical circuit 1 is above the threshold value $I_n$. The second fuse 10 then begins to melt, and the electrical arc A appears across its terminals. This electrical arc A causes the appearance of an electrical supply voltage V, which is then supplied to the command circuit 14. Indeed, the rated voltage $V_{10}$ of the second fuse 10 is chosen such that the electrical arc A remains present across its terminals while it is in the process of melting, as long as the current I is circulating.

Figure 3:
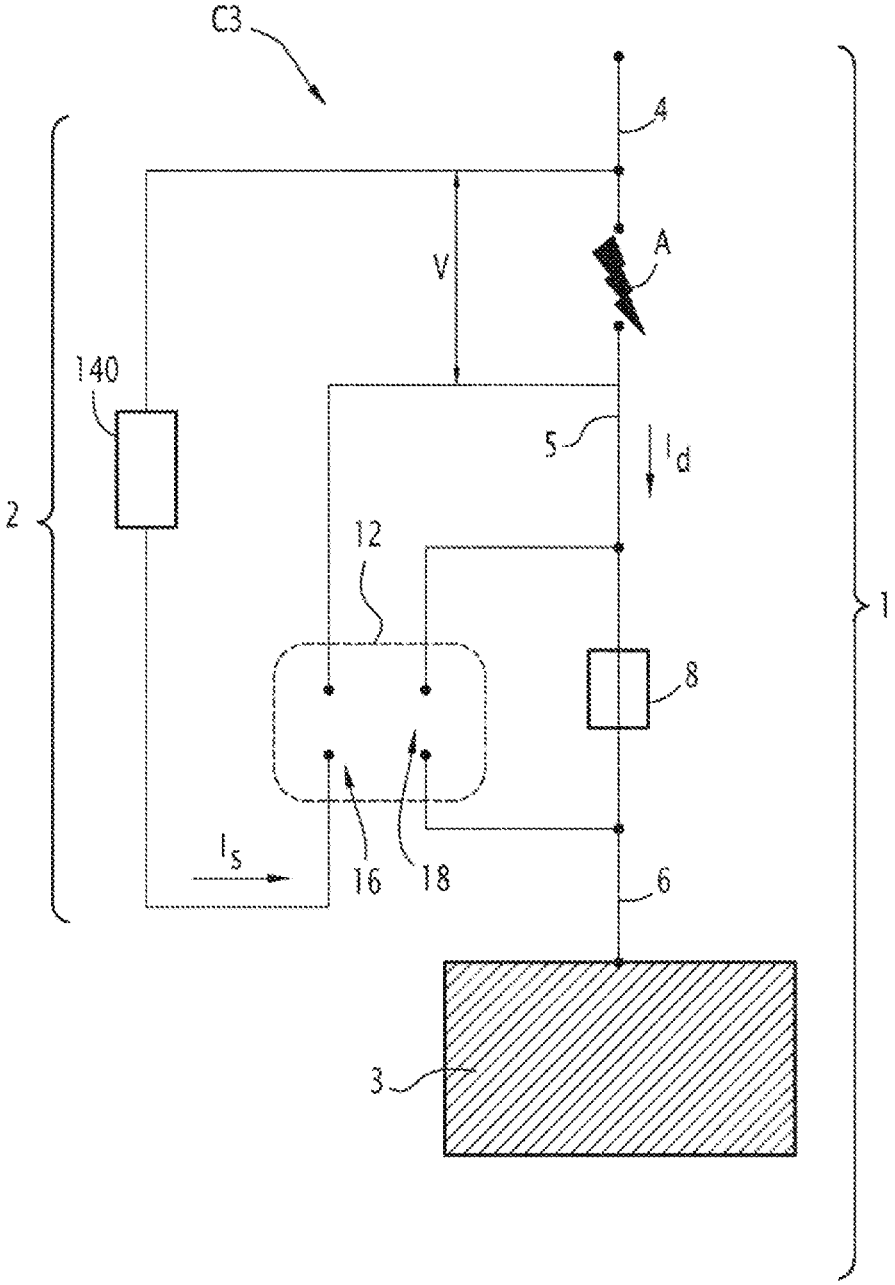
FIG. 3 is an illustration similar to FIG. 2, when the pyroswitch is open.

In the second intermediate configuration C3 shown in FIG. 3, the pyroswitch 12 is triggered and the first fuse 8 is closed. The command circuit 14, supplied with the voltage V, then develops from this voltage V and transmits the triggering signal S, in the form of the current $I_S$, to the electrical resistance 20 of the command zone 16, while triggering the pyroswitch 12, which quickly opens the power zone 18. Thus, the electrical current I traverses the first fuse 8.

Figure 4:
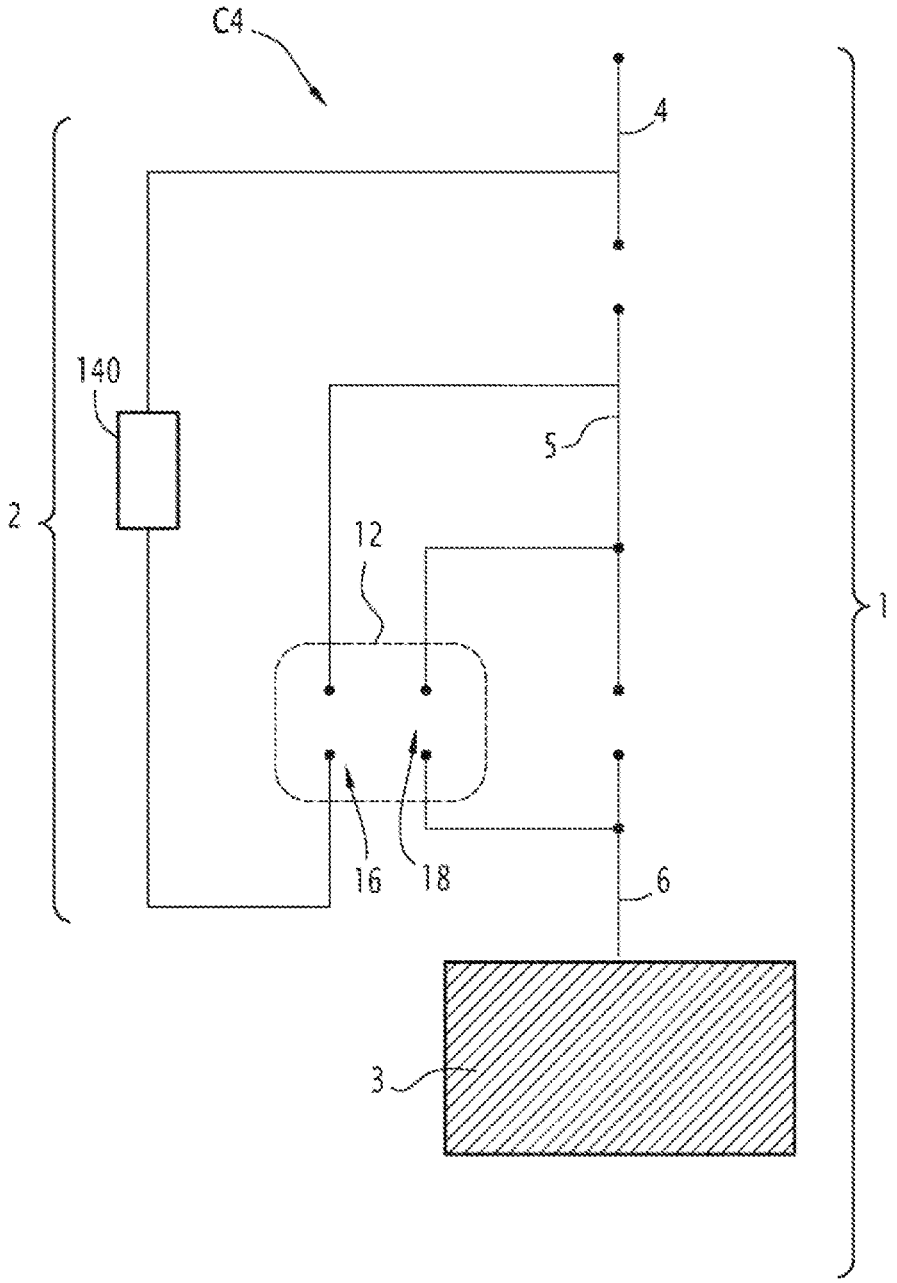
FIG. 4 is an illustration similar to FIG. 3, when a first fuse is melted.
Figure 5:
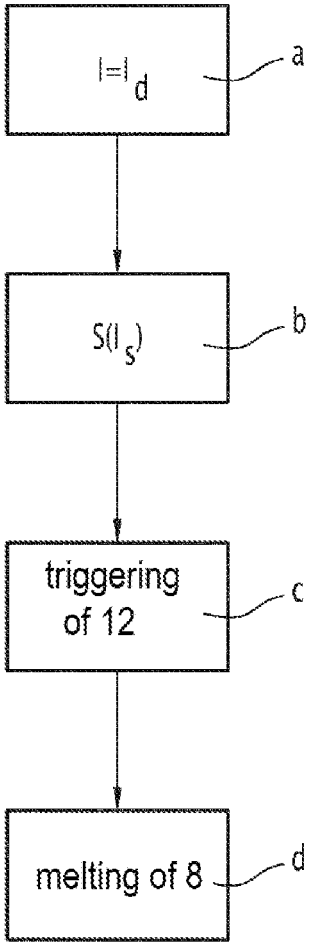
FIG. 5 is a block diagram of a protection method according to the invention.

In the open configuration C4 shown in FIG. 4, the first and second fuses 8 and 10 are melted. Indeed, once one reaches the second intermediate configuration C3, the fault current causes the first fuse 8 to melt after a predetermined length of time of several ms (ms), which depends on the characteristics of the first fuse 8. Since the value of the cutoff current $I_8$ of the first fuse 8 is chosen to be significantly lower than the nominal value $I_n$, the first fuse 8 melts very quickly once it is traversed by the current I. The rated voltage $V_8$ of the first fuse being equal to the nominal value $V_n$, the fuse melts quickly and the electrical arc across its terminals does not remain established for long, unlike the first fuse 10.

In FIG. 1, the command circuit 14 is shown as being a "housing" connected between the second fuse 10 and the command zone 16. In FIGS. 2 to 4, the command circuit 14 is shown by an electrical resistance 140, for the reasons developed below. The electrical resistance 140 is subjected to the supply voltage V generated across the terminals of the second fuse 10. Here, the value of the resistance 20 is less than ten times or one hundred times the value of the resistance 140. It is therefore the value of the resistance 140 that dimensions the value of the current $I_S$ transmitted to the command zone 16. Indeed, independently of the electrical components of the command circuit 14, the latter can be shown electrically by a simple resistance 140 in an electrical diagram, as is the case in FIGS. 2 to 4. In the diagrams of FIGS. 2 to 4, the electrical resistance 140 is electrically connected in series with the electrical resistance 20. The assembly formed by the resistance 20 and the resistance 140 is electrically connected in parallel with the second fuse.

A method for protecting the electrical circuit 1, equipped with the protective device 2, is implemented when an electrical current I greater than the nominal current $I_n$ occurs in the electrical circuit 1 and traverses the protective device 2. In this case, the overcurrent $I_d$ is strictly greater than zero. By default, the protective device 2 is in the closed configuration C1, since the electrical current I supplies the electrical circuit 1 and the first and second fuses 8 and 10 are not melted. The protection method is described below.

At the beginning of this method, and during an initial step a), a fault occurs in the supply of the electrical device 1 and the electrical current traverses the protective device 2. Due to the electrical current, and in a time interval predetermined by the caliber of the second fuse 10, the second fuse 10 begins to melt and the electrical work A settles in across the terminals of the second fuse 10. As mentioned above, the second fuse 10 is dimensioned such that the electrical arc A remains present across its terminals while it is in the process of melting, while the current I is present, which generates the supply voltage V and ensures the passage of the current. This voltage V is used to supply the command circuit 14. At the end of step a), the protective device 2 is in its first intermediate configuration C2 where the second fuse 10 is in the process of melting and the supply voltage V is supplied to the command circuit 14. As mentioned above, since the command circuit 14 is a passive circuit, the supply voltage V supplied by the second fuse 10 is the only supply source of the command circuit 14 necessary for the operation thereof. Thus, during step a), the method includes melting the second fuse 10 caused by the electrical current I greater than $I_n$, and supplying the command circuit 14.

The method next includes a step b) in which the command circuit 14 develops the triggering signal S, which corresponds to the triggering electrical current $I_S$. Next, the command circuit 14 transmits this triggering current $I_S$ to the pyroswitch 12, in particular to the command zone 16 of the pyroswitch 12. Since the electrical arc A is still present across the terminals of the second fuse 10, the fault current $I_d$ again traverses the power zone 18 of the pyroswitch 12. During step b), the method includes transmitting, using the command circuit 14, the triggering signal S to the pyroswitch 12.

Next, the method includes a step c) that includes triggering the pyroswitch 12 and cutting off the power zone 18 of the pyroswitch 12. In practice, the electrical current $I_S$ traverses the electrical resistance 20 of the command zone 16, which heats up and triggers the detonation of the explosive agent of the pyroswitch 12. As explained above, the detonation of the explosive agent causes the cutoff element to switch from its first position toward its second position so as to cut off the power zone 18 of the pyroswitch 12. At the end of step c), the protective device 2 is in its second intermediate configuration C3 where the pyroswitch 12 is triggered, the power zone 18 is open and the first fuse 8 is still closed.

Lastly, the method includes a step d) in which the electrical current traverses the first fuse 8, since the power zone 18 of the pyroswitch 12 is open. The first fuse 8 being undersized relative to the second fuse 10, the first fuse 8 melts quickly due to the electrical current I. Thus, the protective device 2 ensures the opening of the electrical circuit 1, since no electrical arc is established across the terminals of the zone 18 of the switch 12. An electrical arc can appear across the terminals of the first fuse 8 when it melts, but it is extinguished quickly because the rated voltage of this fuse 8 is of the same order of magnitude as the rated voltage $V_n$. Once the first fuse 8 has melted, the electrical circuit opens and the current I no longer circulates. The arc A is extinguished in turn, and the second fuse 10 melts completely. The protective device 2 is then in its open configuration C4, where the first and second fuses 8 and 10 are melted.

Figure 6:
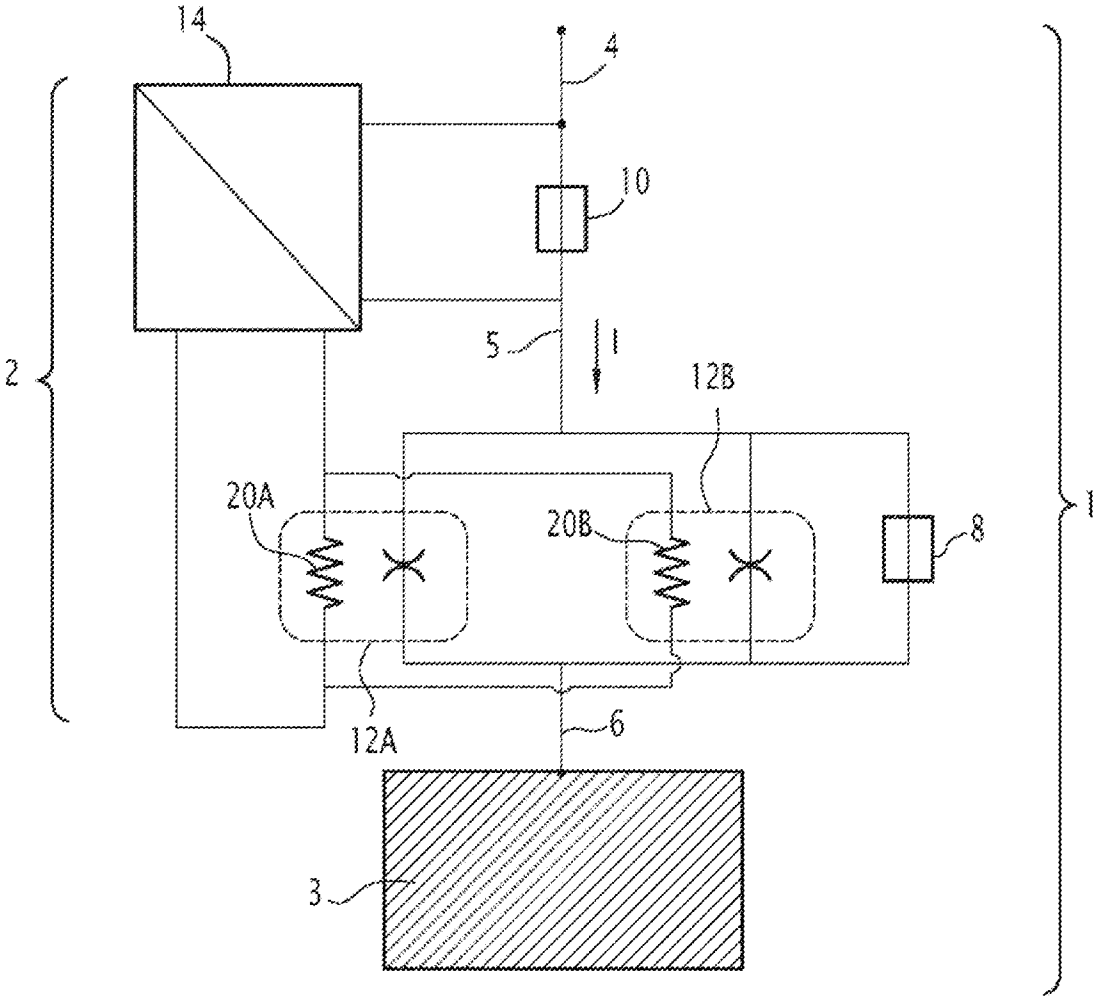
FIG. 6 is an illustration similar to FIG. 1, for a protective device and a circuit both according to a second embodiment of the invention.

FIG. 6 shows a second embodiment of the invention. The elements of the protective device 2 according to this embodiment that are similar to those of the first embodiment bear the same references and are not described in detail, inasmuch as the above description can be transposed to them. The protective device 2 comprises two pyroswitches 12A and 12B. The two pyroswitches 12A and 12B are connected in parallel to the first fuse 8 between the input conductor 4 and the output conductor 6. In particular, each pyroswitch 12A and 12B includes an electrical resistance 20A and 20B. The electrical resistances 20A and 20B are in parallel and are also traversed by a part of the triggering electrical current $I_S$, which causes the heating of these resistances 20A and 20B, as explained above.

According to an alternative that is not shown in the figures, the protective device 2 includes three or more than three pyroswitches connected in parallel.

Introducing several pyroswitches connected in parallel allows the protective device 2 to cut off an electrical current I having a very high intensity. For example, for the alternative shown in FIG. 6, each pyroswitch 12A and 12B is configured to cut off a fault current $I_d$ having an intensity of 200 amperes. Thus, the protective device 2 is able to cut off an electrical current I having a total intensity of 400 amperes.

Alternatively, the charge 3 is electrically connected to the first conductor 4. The electrical current 1 then circulates from the second conductor 6 toward the first conductor 4 in a normal operating regime.

The alternatives considered above may be combined to create new embodiments of the invention.

The invention claimed is:

1. A protective device for an electrical circuit, configured to transmit an electrical current, the protective device comprising:

a first conductor, a second conductor, a first fuse connected to the second conductor, at least one pyroswitch connected in parallel to the first fuse, the pyroswitch including a command zone, able to receive a triggering signal, and a power zone for the passage of the electrical current, and a command circuit configured to develop and transmit the triggering signal to the command zone of the pyroswitch, wherein the device further comprises a second fuse connected in series between the first conductor and the first fuse and able to provide a supply voltage to the command circuit, and wherein the command circuit is connected between the second fuse and the command zone of the pyroswitch.

2. The device according to claim 1, wherein:

the cutoff current of the second fuse is equal to a nominal electrical current value, this nominal current value being defined as the maximum value of the current provided to circulate in the protective device in normal operation, and wherein the cutoff voltage of the first fuse is equal to a nominal electrical voltage value, this nominal voltage value being defined as the maximum value of the voltage provided to be applied across the terminals of the protective device in normal operation.

3. The device according to claim 1, wherein the power zone of the pyroswitch has an electrical resistance at least ten times smaller than that of the first fuse.

4. The device according to, claim 2 wherein:

the cutoff current of the first fuse is at least four times less than or equal to the nominal electrical current value, and wherein the cutoff voltage of the second fuse is at least four times less than or equal to the nominal electrical voltage value.

5. The device according to claim 1, wherein the device is configured to be successively in:

a closed configuration, where the first and second fuses are not melted, a first intermediate configuration where the second fuse is in the process of melting and the supply voltage is supplied to the command circuit, a second intermediate configuration where the pyroswitch is triggered and the first fuse is not melted, and an open configuration, where the first and second fuses are melted.

6. The device according to claim 1, wherein it comprises at least two pyroswitches connected in parallel to the first fuse between the first conductor and the second conductor.

7. The device according to claim 1, wherein the command circuit includes a potentiometer able to control the triggering signal sent to the command zone of the pyroswitch.

8. An electrical circuit configured to be supplied with an electrical current, the electrical circuit being equipped with a protective device according to claim 1.

9. A method for protecting an electrical circuit configured to be supplied with an electrical current and being equipped with a protective device according to claim 1, the method comprising:

a) melting the second fuse caused by a fault current and supplying the command circuit, b) transmitting, using the command circuit, the triggering signal to the pyroswitch, c) triggering the pyroswitch and cutting off the power zone of the pyroswitch, and d) melting the first fuse caused by the fault current.

10. The method according to claim 9, wherein, during melting, the supply voltage of the command circuit is generated by an electrical arc that is established across the terminals of the second fuse.

* * * * *